US008403699B1

(12) United States Patent
MacNeil et al.

(10) Patent No.: US 8,403,699 B1
(45) Date of Patent: Mar. 26, 2013

(54) STRAIN RELIEF ELECTRICAL CABLE CONNECTOR

(75) Inventors: John J. MacNeil, Valrico, FL (US); Ellen Buell Throdahl, Clearwater, FL (US); John Hackney, Thonotasassa, FL (US); Bruce Boyer, Hudson, FL (US); Robert DeRoss, Plainfield, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/105,615

(22) Filed: May 11, 2011

Related U.S. Application Data

(60) Provisional application No. 61/333,611, filed on May 11, 2010.

(51) Int. Cl.
*H01R 13/58* (2006.01)

(52) U.S. Cl. ..... 439/460

(58) Field of Classification Search ..... 439/460, 439/404, 395, 417–418, 425, 465, 608
See application file for complete search history.

(56) References Cited

U.S. PATENT DOCUMENTS

| | | | | |
|---|---|---|---|---|
| 5,591,046 | A * | 1/1997 | Klein et al. | 439/467 |
| 6,238,231 | B1 * | 5/2001 | Chapman et al. | 439/404 |
| 6,726,503 | B2 * | 4/2004 | Waddell et al. | 439/465 |
| 7,578,695 | B2 * | 8/2009 | Boeck et al. | 439/463 |
| 7,972,183 | B1 * | 7/2011 | Lin | 439/676 |

* cited by examiner

*Primary Examiner* — Jean F Duverne
(74) *Attorney, Agent, or Firm* — Larry I. Golden

(57) ABSTRACT

A strain relief electrical cable connector for facilitating ready connection and disconnection of non-metallic, sheath cables and capable of withstanding a 60 pound pull force for 5 minutes without the assistance of terminals or additional hardware. The connector includes a pair of identical, interlocking connector portions, each having a cover and pivotally connected housing. Each cover including a pair of integrally formed, spaced apart projections having inwardly directed, angularly disposed strain relief fingers and further including inwardly directed, angularly disposed wire support standoffs which are provided with a serrated cam exterior portion. The covers also provide wire guide means and a guide post intermediate the guide means and the serrated cam portion. Each housing is provided with terminal retention channels and terminals received therein for connection at one end with the cable wiring and at the other end with associated terminals of the interlocking connector portion. The cover and housing are provided with locking latches and associated ribs for securely locking the cover to the housing once the wiring in properly positioned.

9 Claims, 11 Drawing Sheets

Free body Diagram of Static Equilibrium for each COC style.

Note: W = 30 lbs is half of UL 60 lb pull test since there are two wires (15a and 15c) supported in each connector.
"a" = Item 44
Post = item 52

Since the conductor wire is rigid - Moments about "a" are in equilibrium and a couple exists between "a" and each post (F3 & F4) to create and maintain force F2.

$\Sigma Ma = 0$ $\uparrow \Sigma Fy = 0$
$W=(-30) + F2 \sin\theta = 0$
$F2 = 30/\sin\theta$ $\rightarrow \Sigma Fx = 0$
$-F2 \cos\theta + F1 = 0$
$F1 = F2\cos\theta$

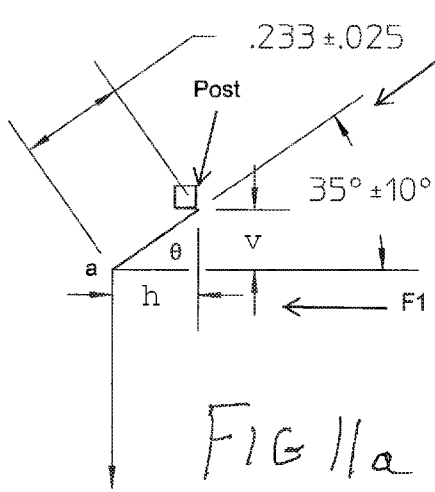

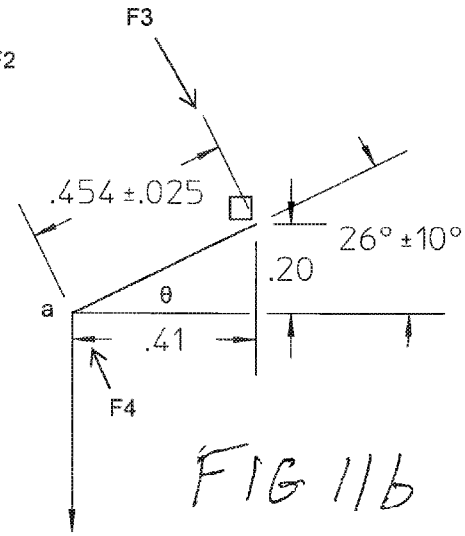

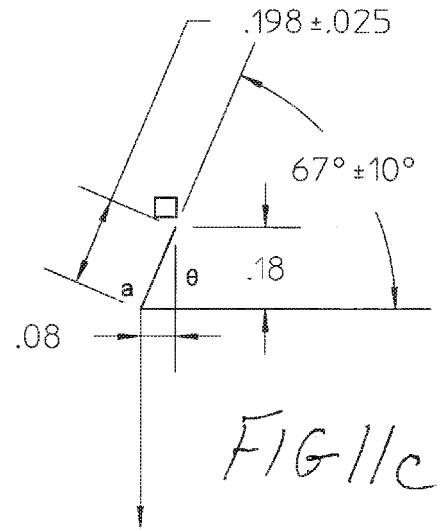

30 lbs

COC-1

$\uparrow \Sigma Fy = 0$
$W=(-30) + F2 \sin\theta = 0$
$F2 = 30/\sin 35 = \sim 52$ lbs $\rightarrow \Sigma Fx = 0$
$-F2 \cos\theta + F1 = 0$
$F1 = F2\cos 35 = \sim 43$ lbs 30 lbs

COC-2

$\uparrow \Sigma Fy = 0$
$W=(-30) + F2 \sin\theta = 0$
$F2 = 30/\sin 26 = \sim 68$ lbs $\rightarrow \Sigma Fx = 0$
$-F2 \cos\theta + F1 = 0$
$F1 = F2\cos 26 = \sim 62$ lbs 30 lbs

COC-3

$\uparrow \Sigma Fy = 0$
$W=(-30) + F2 \sin\theta = 0$
$F2 = 30/\sin 67 = \sim 33$ lbs $\rightarrow \Sigma Fx = 0$
$-F2 \cos\theta + F1 = 0$
$F1 = F2\cos 67 = \sim 13$ lbs

STRAIN RELIEF ELECTRICAL CABLE CONNECTOR

RELATED APPLICATIONS

This application claims priority to U.S. Provisional Application No. 61/333,611, filed May 11, 2010, which is incorporated herein by reference in its entirety.

FIELD OF THE INVENTION

This invention relates generally to electrical cable connectors and is particularly directed to a non-metallic, sheath cable connector having built-in strain relief capable of withstanding higher pull forces on the cables connected therein.

BACKGROUND OF THE INVENTION

Strain relief electrical cable connectors of this type are utilized to facilitate ready electrical connections for residential wiring including, but not limited to, the modular home and RV industries. These connectors may be used to connect cables in various manners including three and four wire straight-line and "T" configurations. The connectors facilitate plug-and-play electrical connection without use of a junction box and permit ready mating, disconnection and remating to accommodate various and changing electrical needs.

Whereas earlier test standards for these types of connectors permitted the use of terminals and required the cables to withstand a pull force of 20 pounds for 1 minute, more recent standards require the connector to withstand a 60 pound pull force for 5 minutes, without the assistance of terminals. It is also desirable to provide this increased retention force without the use of fasteners (screws or other fastening hardware) during installation.

OBJECTS AND SUMMARY OF THE INVENTION

It is an object of the invention to provide a non-metallic, sheath cable connector having internal configuration providing built-in strain relief capable of withstanding a pull force of 60 pounds for 5 minutes without the assistance of terminals without the use of fastening screws or other fastening hardware during installation.

BRIEF DESCRIPTION OF THE DRAWINGS

FIG. 11*a* shows a free body diagram for a three wire connector as shown in FIG. 2.

FIG. 11*b* shows a free body diagram for a four wire connector as shown in FIG. 12.

FIG. 11*c* shows a free body diagram for a T-connector as shown in FIG. 13.

DETAILED DESCRIPTION

Figure 1:
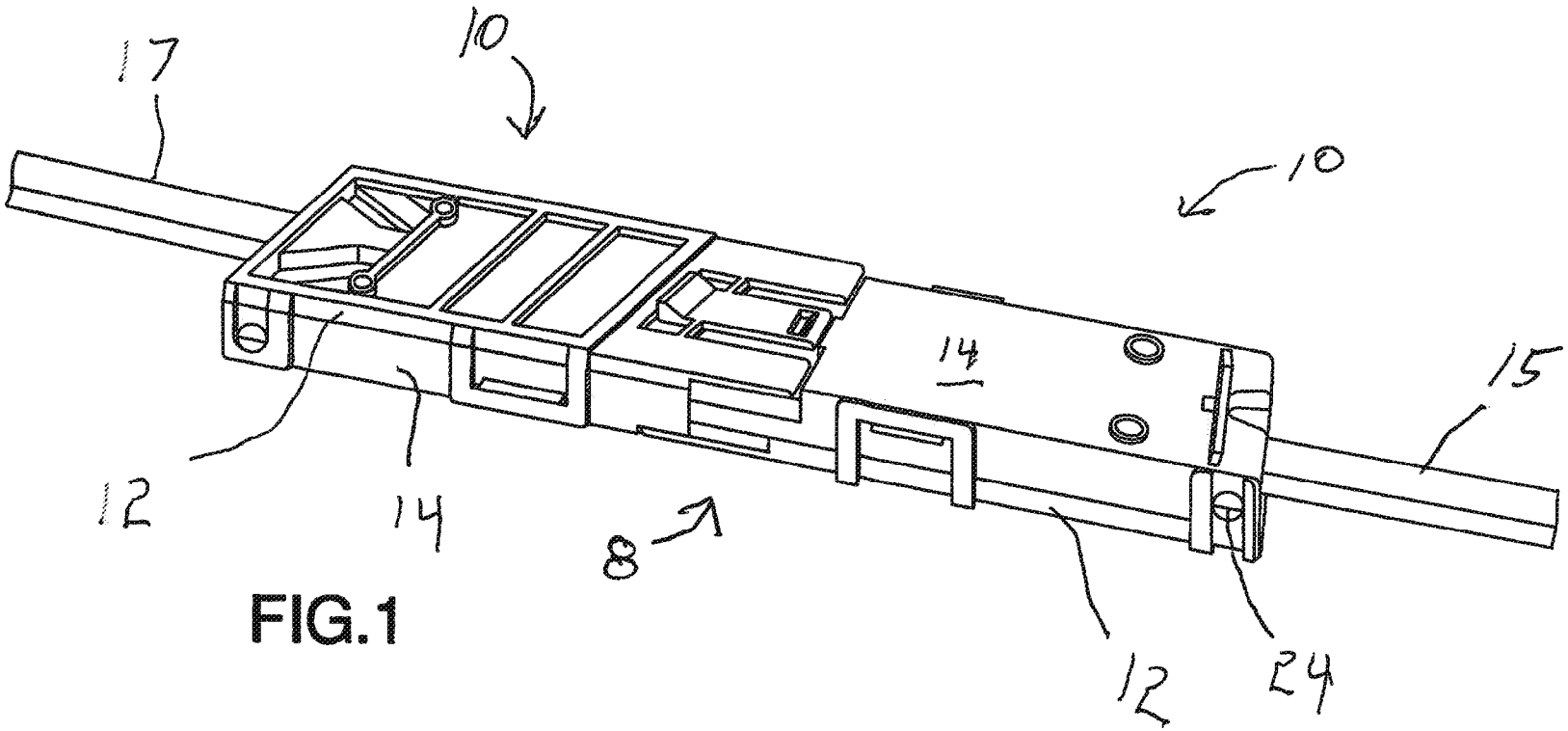
FIG. 1 is a perspective view of the connector showing interlocking connector portions in a preferred embodiment.
Figure 2:
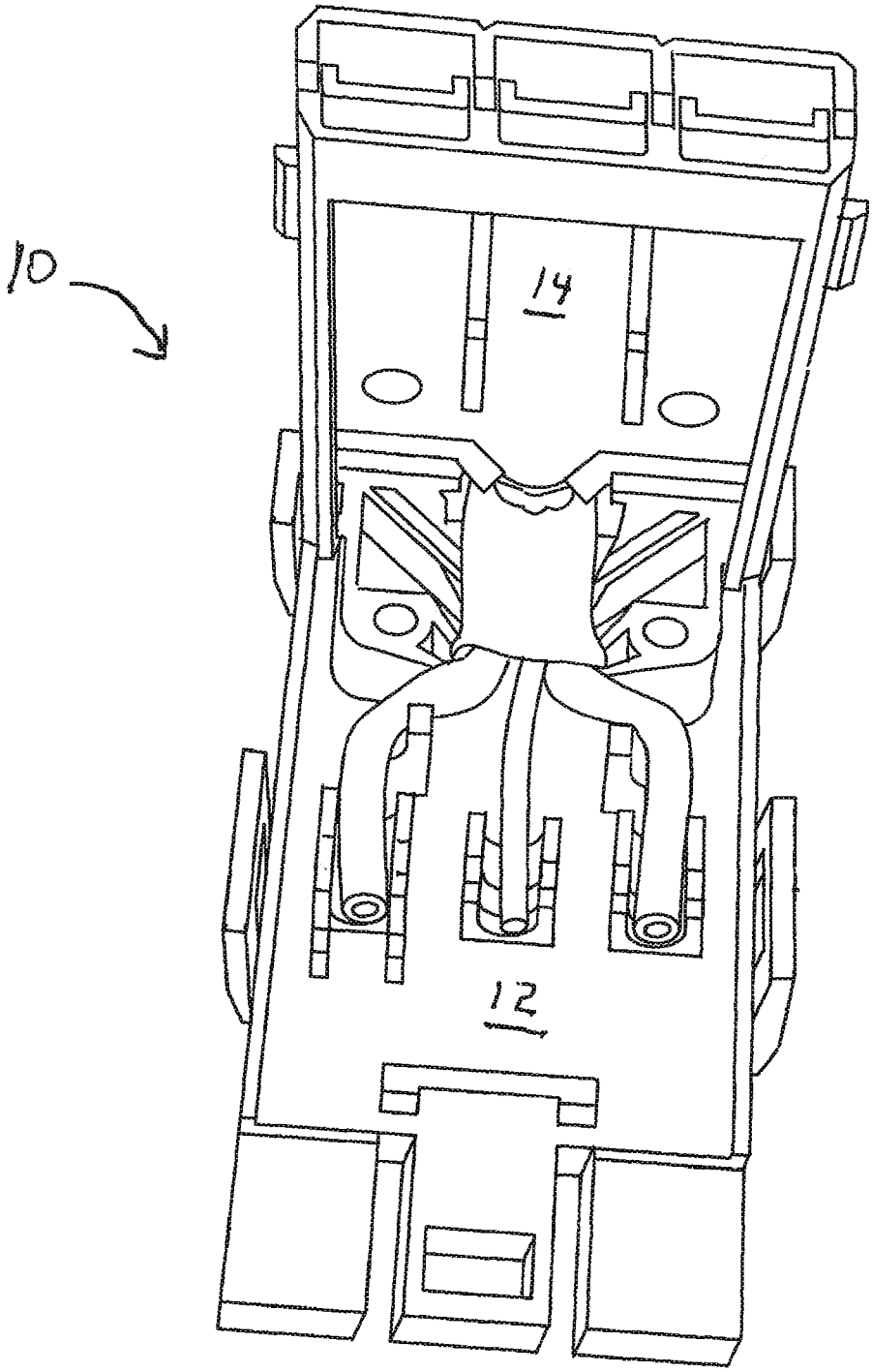
FIG. 2 shows one connector portion of the three wire connector shown in FIG. 1 in an open position.
Figure 4:
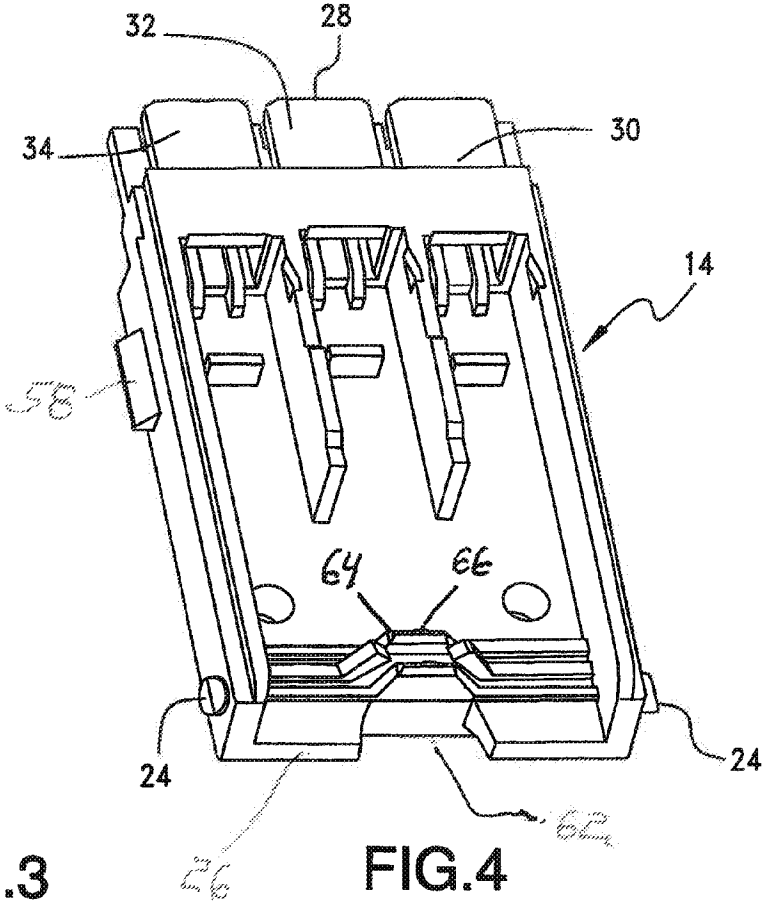
FIG. 4 shows the housing of the connector portion shown in FIG. 2.

The connector 8, as shown in FIG. 1, is formed from identical, interlocking hermaphroditic connector portions 10, each including a cover 12 which is pivotally connected to a housing 14 as can be seen in FIG. 2. Each can be made of a dielectric material. For example, the cover shown in FIG. 3 can be made of a commercially available polycarbonate such as Lexan 940—clear, while the housing shown in FIG. 4 can be made of a thermoplastic polyester resin such as Valox 365.

The connectors are constructed to connect a pair of multiple-wire cables 15, 17, commonly of the three-wire or four-wire variety. The cover includes multiple integrally formed features to provide proper positioning of each wire and to facilitate the required pull force withstand for the connector.

Connectors of this type are sometimes referred to as "cross-over connectors" (COC) and are subject to UL standard 2256 requiring the connector to withstand a 60-lb pull force for 5 minutes without the assistance of terminals. A connector portion 10 will first be described for the retention of a three-wire cable with reference to the cover in FIG. 3. The cover 12 includes a first end 16 adapted to pivotally retain the housing 14 and an opposite end 18 which is connected to the interlocking connector portion 10 for connecting cable 15 to cable 17 through the interlocking connector portions 10 via terminals 36*a*, 36*b*, 36*c* carried by the respective housings 14 which will be hereinafter described.

Figure 5:
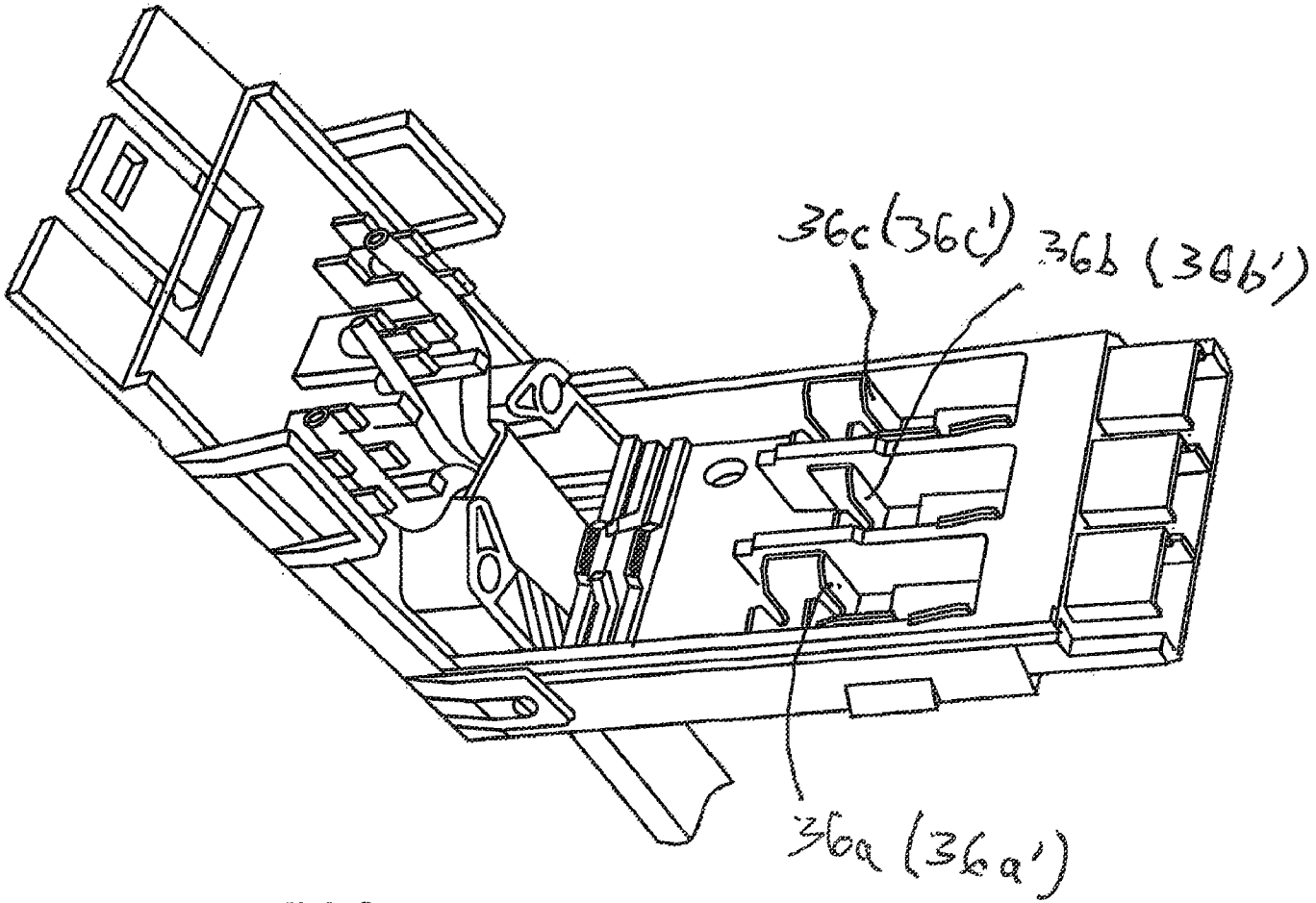
FIG. 5 is a perspective view of the connector portion as shown in FIG. 2 including the terminals retained in the housing.
Figure 6:
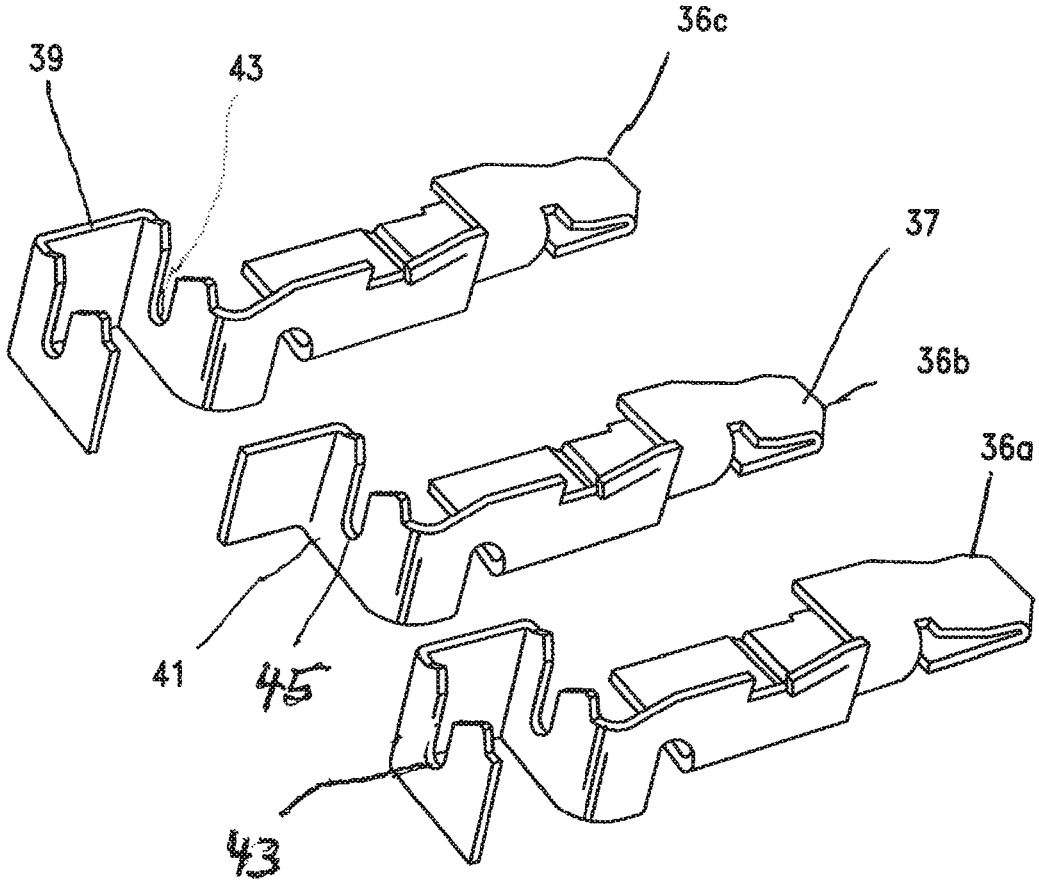
FIG. 6 is a perspective view showing the terminals seen in FIG. 5.
Figure 7:
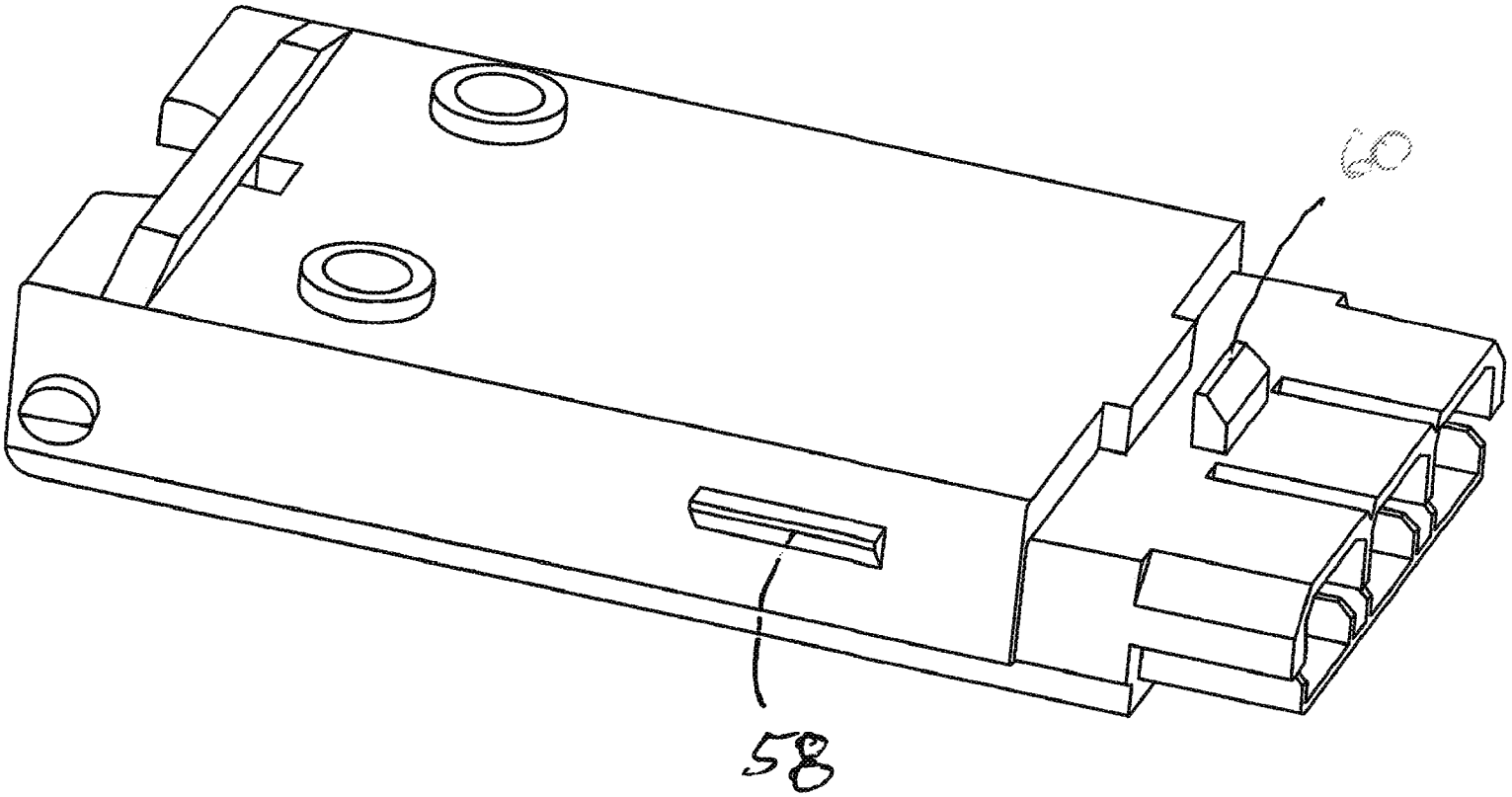
FIG. 7 is a perspective view of a connector portion in a closed position.

Upstanding tabs 20 on the cover each include a hinge slot 22 for retention of a hinge post 24 which extends from each side of the pivotally connected end 26 of the housing 14. The opposite end of the housing 28 includes terminal retention channels 30, 32, 34 for respective retention of terminals 36*a*, 36*b* and 36*c* adapted for respective connection to the terminals 36*c*', 36*b*', 36*a*' of an identical connector portion 10 which is rotated 180 degrees so that the housing of the first connector portion 10 connects with the cover of the second connector portion 10 and the cover of the first connector portion 10 connects with the housing of the second connector portion 10. The terminals are shown retained in the housing 14 in FIG. 5 and are shown individually in FIG. 6. Each of the terminals has a retention clip portion 37 at its interconnection end. Each of the outer terminals 36*a*, 36*c* includes a generally U-shaped insulation displacement connector portion 39 at its opposite end while the center terminal 36*b* includes a generally L-shaped insulation displacement connector portion 41. Each of the outer terminals 36*a*, 36*c* has two slots 43 forming a double insulation displacement electrical connection with the wire retained therein while the center terminal 36*b* includes a single slot 45 for retention of the center ground wire.

When the interlocking connector portions 10 are connected, the terminal 36*a* from the first connector portion is electrically connected with terminal 36*c*' of the second connector portion, while terminal 36*c* of the first connector portion is electrically connected with terminal 36*a*' of the second connector portion and terminal 36*b* of the first connector portion is electrically connected with terminal 36*b*' of the second connector portion.

The cover 12 includes a pair of integrally formed, generally L-shaped projections 40 having inwardly directed, angularly disposed generally parallel strain relief fingers 42 and a pair of integrally formed, inwardly directed and angularly disposed wire support standoffs 44. The wire support standoffs have a pin ball flipper cam configuration and include a splined or serrated exterior portion 47 for engagement with the insulation of the outer wires 15*a*, 15*c* while center wire 15*b* extends straight into the connector. The serrated portion of the cam configuration of each wire support standoff provides a static fulcrum for a respective one of each of the outer wires 15*a* and 15*c*.

A pair of parallel cable sheath protrusions 46 extend between the ends of the opposite relief fingers 42, with each protrusion having a centrally located raised nub or ground wire protrusion 48. Further inward on the cover are generally U-shaped wire guides 50. The center wire, in this case ground wire, is provided with two generally U-shaped projections while each of the outer insulated wires 15*a*, 15*c* are provided with two U-shaped projections and a half-U wire guide post 52 which projects intermediate the respective full-U projections and the wire support standoffs 44.

The cover further includes a pair of locking latches 54 and a mating latch 56. The locking latches 54 are respectively adapted to capture a side rib 58 formed on opposite sides of the pivotally connected housing 14. The mating latch is adapted for capture of an outer rib 60 extending from the outside of the housing of the adjoining or mating connector at the terminal end 28 of the housing.

The housing has a cut-out portion 62 at its pivotally connected end 26 to facilitate entry of the cable 15, 17 into the connector. The housing further includes parallel raised ribs 64, each including a centrally located raised nub 66 to further facilitate firm retention of the cable within the connector.

Figure 3:
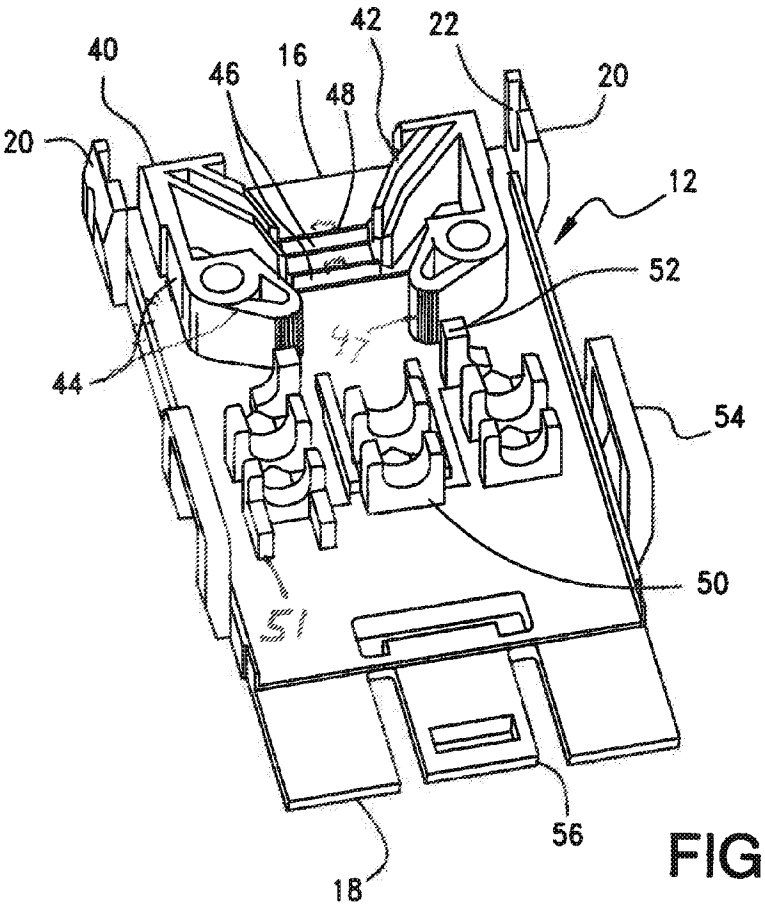
FIG. 3 shows the cover of the connector portion shown in FIG. 2.
Figure 8:
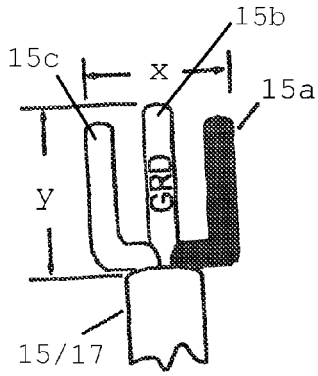
FIG. 8 is a top view showing a three wire cable positioned for insertion in the connector.
Figure 9:
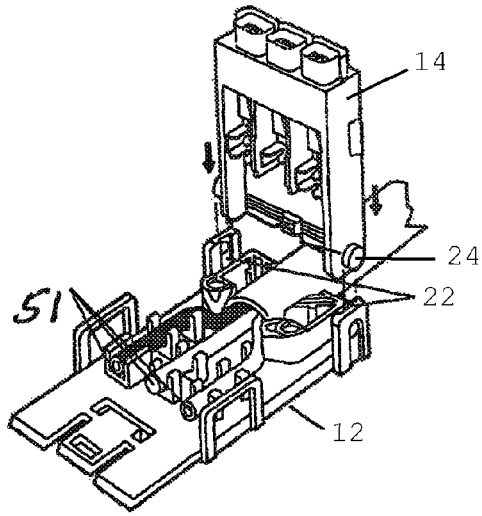
FIG. 9 is a perspective view showing a three wire connector before the housing is connected to the cover.
Figure 10:
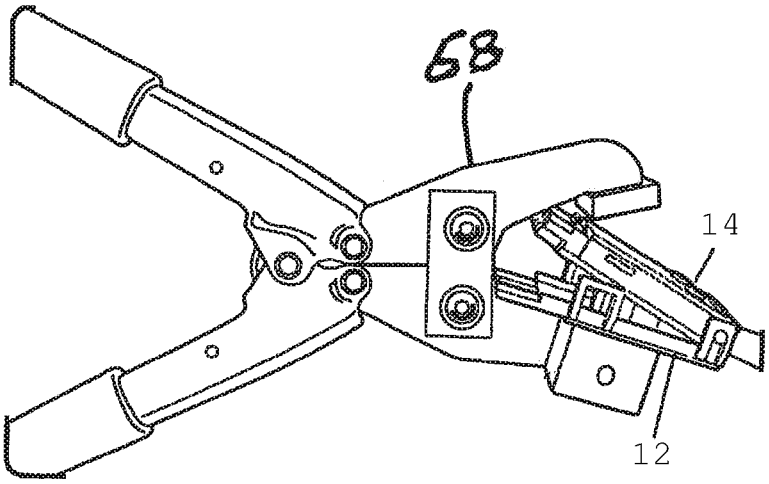
FIG. 10 is a plan view showing a hand tool being applied to the connector for securing the housing to the cover.

Installation of the connector for three-wire cable (2-wire cable with ground applications) will now be described. Each cable 15, 17 should be properly stripped and configured as shown in FIG. 8 with the cable sheath stripped from the wires to leave approximate 1 inch strips, the outer wires bent approximately 90 degrees twice to define a width of approximately 1 inch between the outer edges of the outer wires. The wires are placed into the wire retention projections, making sure the wires do not extend past a predetermined distance defined by a locator stop 51 as can be seen in FIGS. 3 and 9. The locator stop extends a predetermined distance beyond the U-shaped wire guides 50 and is shown here at the end of the location for the left positioned (as seen in FIG. 3) outer wire. The housing is then positioned to insert the hinge posts 24 within the hinge slots 22. The cover 12 is then closed-first by hand and then through use of a hand tool 68 as can be seen in FIG. 10 until the locking latches 54 respectively engage the side ribs 58 on both sides of the housing.

The physical positioning of the wire guide posts 52 with respect to the wire support standoffs 44 are critical to require the near 90 degree double bend in each of the outer wires. The vertical distance from the outer edge of the posts 52 to the vertex of the serrated portion of the support standoff 44 is shown in the free body diagram of static equilibrium of FIG. 11*a* as 0.13 inches, while the horizontal distance from the outer edge of each post to the vertex of the corresponding support standoff is 0.19 inches, resulting in a straight line distance of 0.233 inches. As shown in FIG. 11*a*, for the three wire design, each outer wire must be capable of supporting approximately 30 pounds force in order for the connector to meet the 60 pound test. The dimensions and force calculations are shown for the 3-wire COC in FIG. 11*a*.

Figure 12:
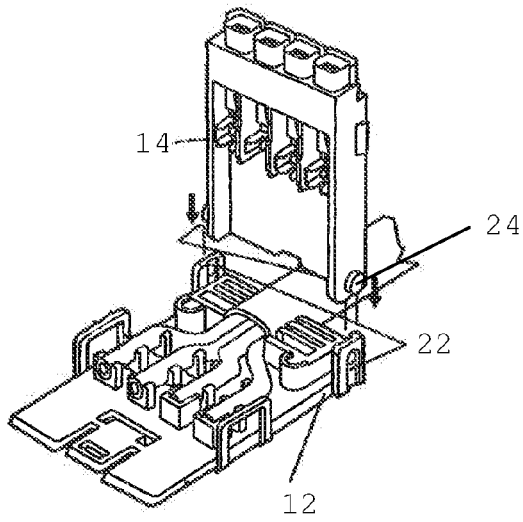
FIG. 12 is a perspective view of a four wire connector before the housing is connected to the cover.
Figure 13:
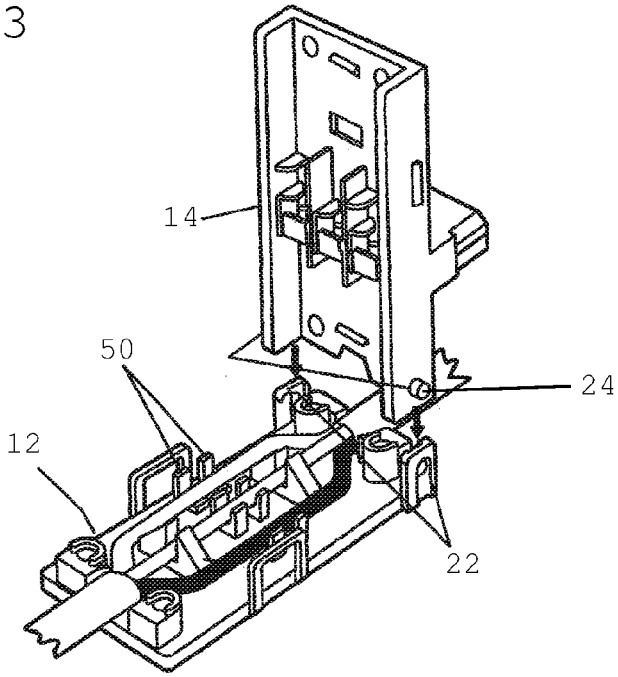
FIG. 13 is a perspective view of a T-connector before the housing is connected to the cover.

The dimensions and force diagram for the 4-wire version connector are shown in FIG. 11*b* while the dimensions and force diagram for a 3-wire T-connector are shown in FIG. 11*c*. The 4-wire version connector is shown in FIG. 12 before the housing is attached to the cover while the 3-wire T-connector is shown in the same condition in FIG. 13. The vertical distance from the outer edge of the posts 52 to the vertex in the 4-wire version is 0.20 inches while the horizontal distance from the outer edge of each post to the vertex is 0.41 inches, resulting in a straight line distance of 0.454 inches. In the 3-wire T-connector, the vertical distance from the outer edge of the posts 52 to the vertex is 0.18 inches while the horizontal distance is 0.08 inches, resulting in a straight line distance of 0.198 inches. These dimensions provide for an F2 angle as shown in FIGS. 11 *a,b* and *c* of 35 degrees for the 3-wire connector, 26 degrees for the 4-wire connector and 67 degrees for the 3-wire T-connector.

A properly terminated wire is fully seated into its proper slots with no significant bow of the cover. The wires must not extend past the locator stops. Once the cover has been closed and the wires electrically connected through the insulation displacement connection of the terminals, the connector portion 10 cannot be opened and re-used, though the connector portion can be mated and unmated multiple times with its associated connector portion without releasing the cover from locked engagement with its pivotally connected housing.

Figure 14:
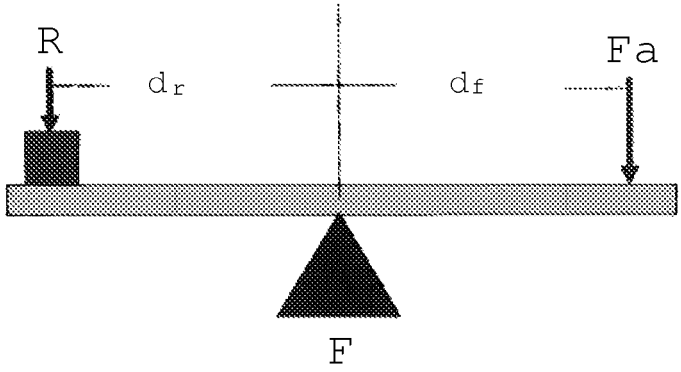
FIG. 14 shows a force diagram for a $1^{st}$ class lever.
Figure 15:
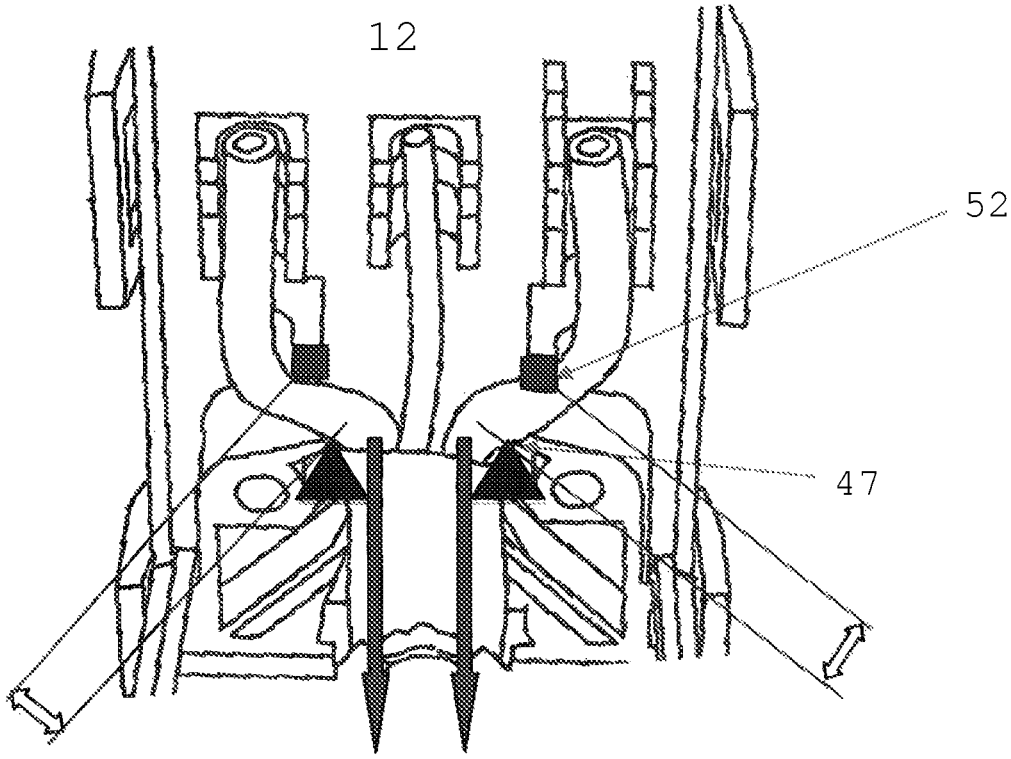
FIG. 15 is a perspective view showing the cover and a force diagram for a three wire connector as shown in FIG. 2.

FIG. 14 shows a force diagram for a $1^{st}$ class lever with a force applied Fa on one side, a resistance R on the other side and a fulcrum F shown at the center. The fulcrum in a first class lever system can often vary in position to favor the force arm distance or the resistance arm distance which is the distance each is spaced away from the fulcrum. FIG. 15 shows how that force diagram applies to the three wire connector where the resistance is provided by the guide posts 52, the fulcrum is provided by the cam-shaped serrated edges 47 and a force applied to the cable is split between the two sides of the connector. In order to withstand a 60 lb. pull test each force line would need to be approximately 30 lbs.

While the present invention has been described with reference to certain embodiments, it will be understood by those skilled in the art that various changes and substitutions may be made and equivalents may be used without departing from the spirit and scope of the invention. It is therefore intended that the invention not be limited to the particular embodiment disclosed, but that the invention will include all embodiments falling within the scope of the appended claims.

We claim:

1. An electrical cable connector comprising a pair of identical, interlocking connector portions, each having a cover and a pivotally connected housing;

said cover including a pair of integrally formed spaced apart projections at a first end, each projection having inwardly directed, angularly disposed strain relief fingers and further including respective inwardly directed, angularly disposed wire support standoffs having a pin ball flipper cam configuration; each of the wire support standoffs having a serrated exterior portion providing a static fulcrum for a pair of electrical wires;

a plurality of cable sheath protrusions extending between ends of the opposite strain relief fingers, each cable sheath protrusion having a centrally located raised nub;

a center wire guide means for receiving a ground wire is positioned further inward from said serrated exterior portions;

an outer wire guide means for receiving a respective one of said electrical wires on each side of said center wire guide means;

a guide post respectively intermediate each said serrated exterior portion and its adjacent outer wire guide means;

said housing pivotally connected to said cover at a first end; said housing including terminal retention channels at an opposite end of the housing;

a terminal retained in each of the channels for establishing an electrical connection with a respective wire of the electrical cable and for establishing respective electrical connection with corresponding terminals of the interlocking connector portion when said interlocking connector portions are connected.

2. An electrical cable connector as claimed in claim 1 wherein said center wire guide means and said outer wire guide means each comprise two generally U-shaped projections.

3. An electrical cable connector as claimed in claim 1 wherein said housing includes parallel raised ribs having a centrally located raised nub cooperatively associated with said cable sheath protrusions for retention of a wire extending therebetween.

4. An electrical cable connector as claimed in claim 1 wherein said cover includes a pair of upstanding tabs at said first end, each tab including a hinge slot; and said housing including a pair of hinge posts extending from said first end of said housing for pivotal retention within said respective hinge slots.

5. An electrical cable connector as claimed in claim 1 wherein the vertical distance from an outer edge of the guide post to a vertex of the serrated exterior portion is 0.13 inches; while the horizontal distance from the outer edge of each guide post to the vertex of the corresponding serrated exterior portion is 0.19 inches.

6. An electrical cable connector as claimed in claim 5 wherein said housing includes three channels; three terminals respectively retained within said three channels, including a pair of outer terminals and a center terminal, each of said terminals having a retention clip portion at the opposite end of the housing.

7. An electrical cable connector as claimed in claim 6 wherein said outer terminals each include a generally U-shaped insulation displacement connector portion while the center terminal includes a generally L-shaped insulation displacement connector portion at the other end of the terminal.

8. An electrical cable connector as claimed in claim 6 wherein said cover includes a pair of locking latches and said housing includes a pair of side ribs on opposite sides of said housing for locking engagement within said latches to secure the cover to the housing.

9. An electrical cable connector as claimed in claim 7 wherein said cover is made of a polycarbonate material and said housing is made of a thermoplastic polyester resin.

* * * * *